US006918798B2

(12) United States Patent
Patel et al.

(10) Patent No.: US 6,918,798 B2
(45) Date of Patent: Jul. 19, 2005

(54) FEMALE TERMINAL WITH FLEXIBLE SIDEWALLS AND FLAT ANGLED CONTACTS

(75) Inventors: Arvind Patel, Naperville, IL (US); Mark M. Data, Bolingbrook, IL (US)

(73) Assignee: Molex Incorporated, Lisle, IL (US)

( * ) Notice: Subject to any disclaimer, the term of this patent is extended or adjusted under 35 U.S.C. 154(b) by 0 days.

(21) Appl. No.: 10/620,229

(22) Filed: Jul. 15, 2003

(65) Prior Publication Data

US 2005/0014422 A1 Jan. 20, 2005

(51) Int. Cl.[7] ..... H01R 11/22
(52) U.S. Cl. ..... 439/851
(58) Field of Search ..... 439/850, 851, 439/852

(56) References Cited

U.S. PATENT DOCUMENTS

| | | | | |
|---|---|---|---|---|
| 3,083,345 A | | 3/1963 | Scheller | |
| 3,178,674 A | | 4/1965 | Scheller | |
| 3,757,284 A | | 9/1973 | Klehm, Jr. | |
| 3,786,401 A | * | 1/1974 | Jones et al. | 439/852 |
| 4,681,393 A | | 7/1987 | Fukishima et al. | |
| 4,708,416 A | * | 11/1987 | Awano | 439/851 |
| 5,145,422 A | | 9/1992 | Fry | |
| 5,383,800 A | | 1/1995 | Saka et al. | |
| 5,437,567 A | | 8/1995 | Peterson | |
| 5,630,738 A | * | 5/1997 | Ito et al. | 439/652 |
| 5,653,616 A | * | 8/1997 | Hotea | 439/851 |
| 6,066,007 A | | 5/2000 | Huang | |
| 6,280,250 B1 | | 8/2001 | Ko | |
| 6,464,547 B2 | | 10/2002 | Ketelsleger | |

OTHER PUBLICATIONS

International Search Report for International Application No. PCT/US2004/021959 mailed on Nov. 23, 2004.

* cited by examiner

*Primary Examiner*—Gary Paumen
*Assistant Examiner*—James R. Harvey
(74) *Attorney, Agent, or Firm*—Stephen Z. Weiss

(57) ABSTRACT

A female terminal with a mating end suited for receiving a male pin with flat surfaces and a circuit-connecting end for connection to a wire. A terminal-receiving passageway at the mating end has two spaced apart sidewalls, which may be in the form of U-shaped channels, extending lengthwise along the passageway with one or more slots separating the U-shaped channels. Enlarged flat contacting surfaces are formed in the opposing sidewalls and are disposed at an angle to the sidewalls. The sidewalls resiliently flex apart from each other as the male pin is inserted into the passageway such that the angled contacting surfaces become coplanar with the flat surfaces of the male pin and electrically contact the male pin over a greater area than that provided by dimples. One or more notches may be disposed at selected points in the sidewalls of the female terminal to better define and control the flexing characteristics of the spaced apart sidewalls.

8 Claims, 6 Drawing Sheets

FEMALE TERMINAL WITH FLEXIBLE SIDEWALLS AND FLAT ANGLED CONTACTS

CROSS-REFERENCE TO RELATED PATENT APPLICATION

This patent application contains common subject matter with another patent application filed on even date herewith, which is entitled "Female Terminal with Sacrificial Arc Discharge Contacts" and which is identified by Ser. No. 10/620,228.

FIELD OF THE INVENTION

This invention relates generally to the art of electrical connectors, and, more particularly, to a female or socket terminal for an electrical connector.

BACKGROUND OF THE INVENTION

Mating electrical connectors typically employ pairs of inter-engaging pin and socket terminals for interconnecting a plurality of circuits or wires through the mated connectors. The pin and socket terminals are often called male and female terminals.

One type of female terminal includes a generally rectangular socket or receptacle at its mating end for receiving a generally rectangular pin or male terminal therein. The mating end is formed by an elongate body defining top and bottom walls and opposite cantilevered sidewalls. Such terminals are conventionally stamped and formed from sheet material and the top and bottom walls may have open seams or slits, whereby the opposite walls can flex about axes generally perpendicular to the elongated axis of the terminal. This type of flexing creates certain problems.

For example, dimples are typically formed on opposite sidewalls at the mating end of the female terminal to establish more positive contact with the inserted male pin or terminal. Preferably, a pair of longitudinally spaced contacting dimples is formed on each flexible sidewall. In order to achieve a stable electrical connection between the female terminal and the male pin, the dimples in the sidewalls of the female terminal need to exert consistent and equal forces on the pin. Unfortunately, since the sidewalls flex about axes that are generally perpendicular to the longitudinal axis of the terminal, and since the dimples in each pair are spaced longitudinally of the terminal, unequal pressure is typically applied by the contacting dimples to the male terminal when the male terminal is fully inserted. This leads to further complications when the dimples are plated with a highly conductive material, such as gold. Uneven wear then occurs on the dimples, and the gold plating can actually wear off one of the contacting dimples before the other. In some instances the endmost dimple in each longitudinally spaced pair may not contact the pin at all.

Dimples generally provide good engagement between the male pin and the female terminal, but only make electrical contact at a very small point. Because of this relatively small contact area provided by such dimples between the sidewalls of the female terminal and the surfaces of the male pin, heat can build up at the small interface areas provided by the dimples. Such small contact areas are not effective at removing any heat buildup.

Yet another problem with the foregoing terminal structure is that the inserted male terminal tends to seat in the bottom of the female terminal instead of centering therein. With the relatively small contact area that dimples provide, centering of the male terminal becomes important.

U.S. Pat. No. 5,437,567 to Peterson, and which is assigned to the same assignee as the present invention, utilizes a sidewall arrangement in which the male terminal is biased upwardly and is therefore better centered in alignment with the contacting dimples of the female terminal. However, it remains desirable to provide a greater and more effective electrical contact area between the male pin and the female terminal than that provided by a pair of dimples on each of opposing sidewalls. With greater contact areas, centering of the male terminal becomes less critical.

This invention is directed to solving the problems identified above and to satisfying the need for an improved elongated female electrical terminal.

SUMMARY OF THE INVENTION

An object of the present invention is therefore to provide a new and improved female electrical terminal of the character described.

Another object of the present invention is to provide a larger area of electrical contact between a female terminal and a male terminal of the pin type, where a consistent force is maintained across the entire area, to improve electrical conductivity at the contact interface.

A further object of the present invention is to provide a larger area of electrical contact between a female terminal and a male pin to reduce heating at the contact interfaces.

Yet another object of the present invention is to provide a greater area of electrical contact that will survive a greater number of insertion cycles of a male pin in a female terminal before appreciable wear of the plating on the contact interfaces occurs.

A still further object of the present invention is to provide flat, enlarged electrical contacting surfaces on a female terminal that are disposed at an angle to the sidewalls of the female terminal to compensate for the angular flexing of the sidewalls as a male pin is inserted therein, such that the contacting surfaces of the female terminal are in coplanar contacting relationship with flat surfaces of the male pin.

Another object of the present invention is to provide a larger area of electrical contact between a female terminal and a male pin to reduce the pressure and stresses in the terminal and to improve the reliability of the terminal.

In the exemplary embodiment of the invention, a female terminal has a mating end to receive a male pin with spaced apart flat surfaces and a circuit connecting end for connection to a wire, or the like. The elongate body of the female terminal defines a terminal-receiving passageway with two spaced apart sidewalls extending lengthwise along the passageway. Enlarged terminal contacting means project inwardly from at least one of the sidewalls into the terminal-receiving passageway. Preferably, these terminal contacting means are in the form of flat contacting surfaces formed in the opposing sidewalls, and are disposed at an angle to the sidewalls.

According to one aspect of the present invention, the sidewalls of the female terminal are preferably elongated U-shaped channels that are separated by one or more slits defined lengthwise along the elongate terminal. The sidewalls are resilient and flex apart from each other as a male pin is inserted in the passageway between the sidewalls, such as when the male pin engages the flat contacting surfaces disposed in the interior of the passageway. As the male pin is inserted into the passageway, the sidewalls flex and separate along an axis generally parallel to their respective sidewalls and in a direction perpendicular to the passageway. As the sidewalls flex, the angled and flat contacting surfaces of the sidewalls become generally coplanar with the flat surfaces of the male pin for improved surface-to-surface contact over substantially entire area of the flat contacting surfaces. The resilient sidewalls then apply normal forces at the flat contacting surfaces against the male pin for improved electrical contact.

According to another aspect of the present invention, one or more notches or cuts may be defined in the sidewalls or in the generally U-shaped channels to control or to improve the flexing of the sidewalls when the male pin is inserted into the passageway. Such notches may also better define the bending axis of each sidewall, including control over the flexibility of each sidewall, the normal forces exerted by the flat contacting surfaces of the female terminal against the male pin, and the like. These notches will further define the degree of resiliency of the U-shaped channels.

BRIEF DESCRIPTION OF THE DRAWINGS

The features of the present invention which are believed to be novel are set forth with particularity in the appended claims. The invention, together with the further objects and advantages thereof, may best be understood by reference to the following description taken in conjunction with the accompanying drawings, in the several figures in which like reference numerals identify like elements, and in which:

DETAILED DESCRIPTION OF THE INVENTION

Figure 1:
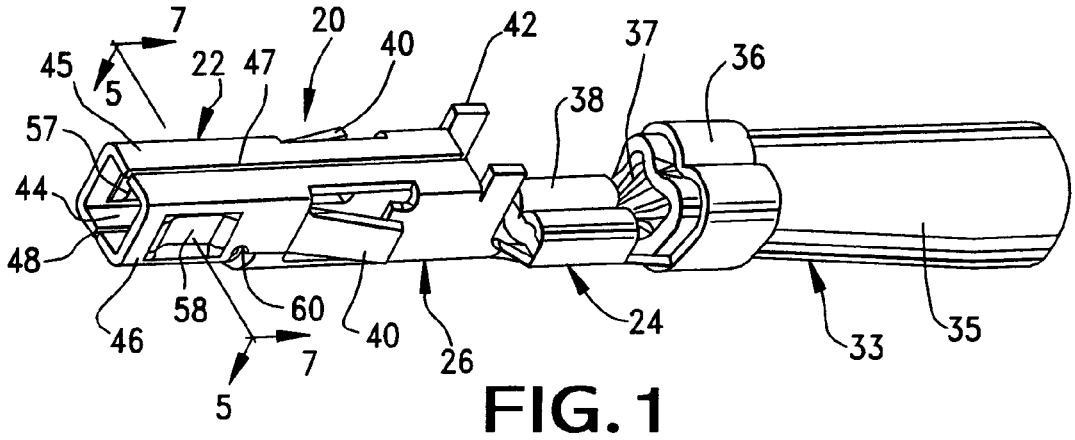
FIG. 1 is a is a perspective view of a female electrical terminal with opposing enlarged and angled contact areas formed in the sides of the electrical terminal in accordance with the present invention.

Referring to the drawings in greater detail, and first to FIG. 1, the invention is incorporated in a generally elongate female electrical terminal, generally designated 20. The female terminal includes a mating portion or end, generally designated 22, a terminating portion or end, generally designated 24, and an intermediate securing portion or section, generally designated 26.

The female terminal 20 is stamped and formed from sheet metal material, and the terminating end 24 is constructed for crimping onto a stripped electrical wire, generally designated 33. More particularly, the terminating end of the female terminal includes a rear pair of crimp arms 36 for crimping onto the outer insulation 35 of the electrical wire 33, along with a forward pair of crimp arms 38 for crimping onto a stripped or exposed end 37 of the conductor or conductive core of wire 33.

Intermediate portion 26 of the female terminal 20 includes a pair of stamped and formed locking arms or tabs 40 which project outwardly from opposite sides of the terminal. These locking arms are cantilevered rearwardly and resiliently snap behind locking shoulders 41 in FIG. 2 on the inside of a connector housing, generally designated 28, to prevent the terminal from backing out of housing 28 after the terminal is inserted therein. The intermediate portion 26 may also include a pair of upwardly projecting tabs 42, which engage stop shoulders (not shown) within the connector housing 28 to define the fully inserted position of the female terminal within the housing, and to also stabilize the terminal within the housing against torsional or rotational movement about the longitudinal axis of the terminal.

Figure 2:
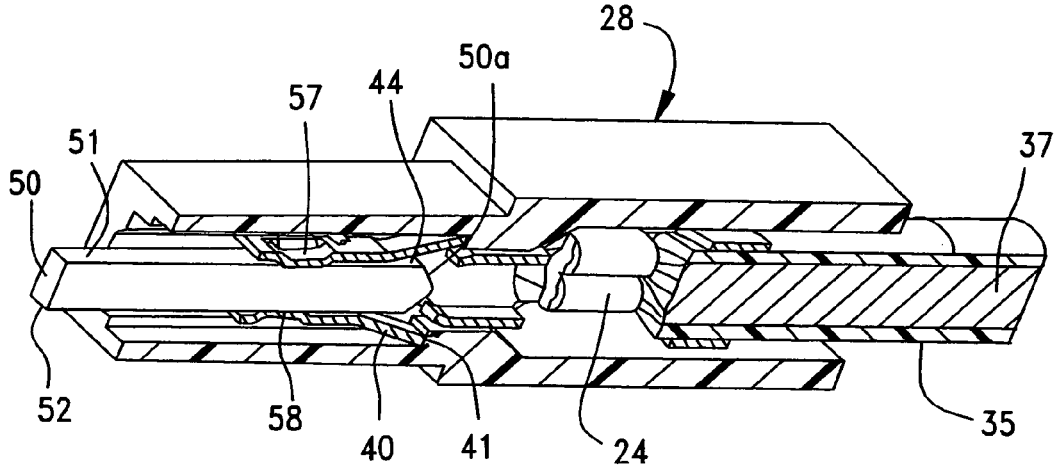
FIG. 2 is a longitudinal sectional view of the electrical terminal of FIG. 1 with the terminal inserted in a housing and with a male terminal or pin inserted in the female electrical terminal.
Figure 3:
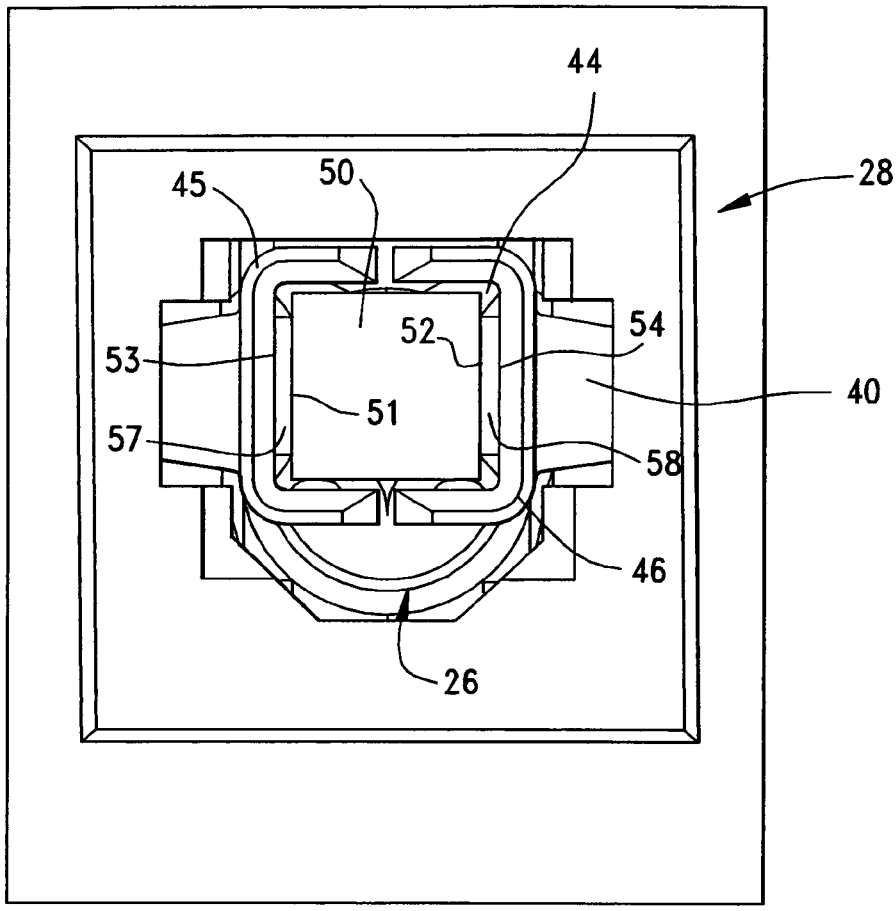
FIG. 3 is an enlarged end view related to FIG. 2 with the electrical terminal of FIG. 1 inserted into a connector housing.

With reference to FIGS. 1–3, the mating end or portion 22 of the female terminal 20 includes a terminal-receiving passageway 44 adapted to receive a male terminal or pin 50. Male pin 50 preferably has at least two spaced apart and generally parallel flat sides 51 and 52, such as are provided by a pin with a square or rectangular cross section. Male pin 50 may also have a tapered or wedge-shaped end **50*a* for ease of insertion of the male pin into the passageway 44**.

In this embodiment, the mating end 22 of the female terminal is formed of a pair of channels 45 and 46 that are of generally U-shaped cross section, and that are separated by open seams or slits 47 and 48 such that the ends of the legs of the U-shaped channels are spaced adjacently to, but apart from each other. Channels 45–46 thereby define a generally rectangular or square passageway 44 therebetween for receiving the correspondingly shaped male terminal 50 therein. The bottoms of the U-shaped channels 45–46 are generally flat to define opposed sidewalls 53 and 54 in the passageway 44, as can best be seen in FIG. 3.

In accordance with one aspect of the present invention, enlarged contact areas 57 and 58 are provided in the passageway 44 to engage and to provide electrical contact between the mating pin 50 and the female terminal 20. These enlarged contact areas 57–58 can, for example, be formed in the respective sidewalls 53–54 by metal forming and stamping techniques that are known in the art. As shown in FIGS. 1 and 2, the enlarged contact areas 57–58 are preferably elongated in the longitudinal direction of the female terminal, and in the longitudinal direction of the male pin 50 to provide an increased area of contact between the male pin and the enlarged contact areas of the female terminal for superior electrical contact and characteristics.

In accordance with another aspect of the present invention, the opposed channels 45–46 which define the passageway 44 are resilient and permit the wedge shaped end 50*a* of the male pin 50 to flex the channels 45–46 apart as the male pin engages the enlarged contact areas 57–58 and is inserted between the enlarged contact areas. As this occurs, the slits 47–48 open to a greater separation at the mating end 22 of the female terminal 20. That is, as the male pin is inserted into the passageway 44, channels 45–46 rotate about a respective line perpendicular to the insertion direction of the male terminal to expand the passageway 44 between the enlarged contact areas 57–58 to accommodate insertion of male pin 50 in the passageway 44 between the enlarged contact areas 57–58. Once the male pin is fully inserted into the passageway, the resiliency of channels 45–46 holds and biases the enlarged contact areas against the male pin 50 by applying normal forces to maintain an improved electrical contact between the male pin and the female terminal. However, it will be appreciated that the force per unit area exerted by the enlarged contact areas against the male pin will be considerably less than with the prior art dimples. Thus, the female terminals of the present invention are less likely to have any plating on the enlarged contact areas worn off by repeated insertion cycles of the male pin 50 into the female terminal 20. The metal plating on female terminal of this invention is therefore able to survive many more insertion cycles than the terminals with the prior art dimples.

Figure 4:
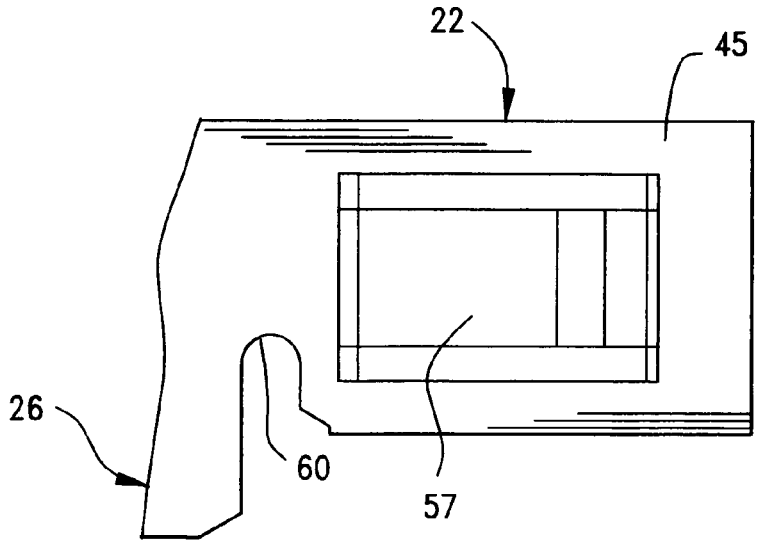
FIG. 4 is an enlarged side elevational view of a portion of the electrical terminal shown in FIG. 1 illustrating a notch disposed near the angled contact areas to provide improved flexibility for the opposing halves of the electrical terminal when a male pin is inserted therein.

In accordance with yet another aspect of the present invention, a notch or recess 60 in FIG. 4 may be stamped, machined or otherwise provided in at least one of the channels 45, and preferably both of the channels 45–46, to affect and to control the flexing and rotation of the channels 45–46 when the male pin 50 is inserted into the passageway 44. This notch can be particularly effective if it is disposed rearwardly of the enlarged contact areas. As shown in FIG. 4, notch 60 is disposed in a transition area between the mating end 22 and the intermediate portion 26 of the female terminal. Thus, channels 45 and 46, rather than flexing mostly along their length, tend to rotate at the area of reduced metal near or around notch 60. Notch 60 therefore better defines the flexing of the sidewalls in the area of the notch and provides improved control of the resiliency of the channels 45–46. Notch 60 thereby also provides a means of controlling and defining the normal forces that the channels 45–46 exert against the male pin 50 at the enlarged contact areas 57–58.

Figure 5:
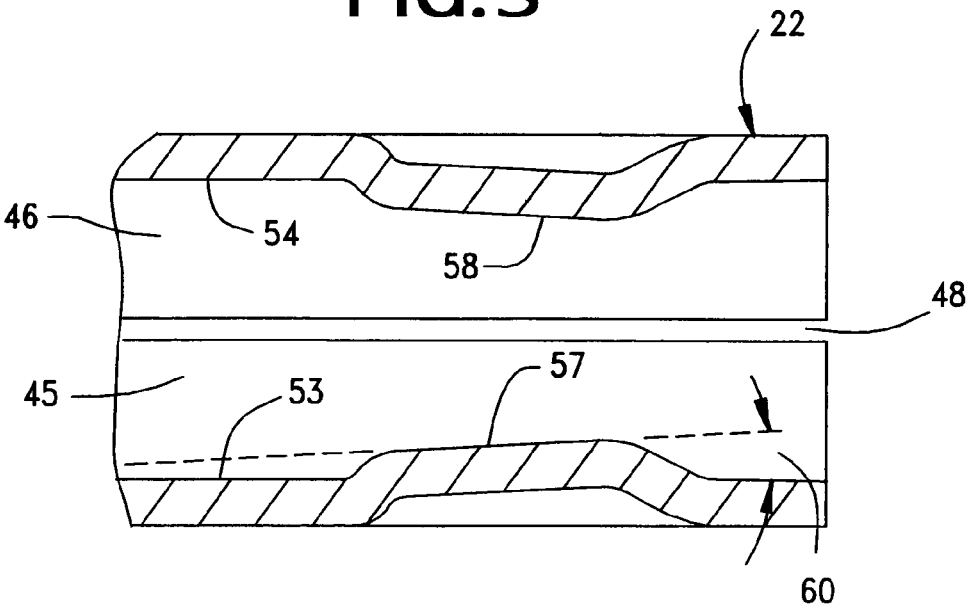
FIG. 5 is an enlarged longitudinal sectional view of the mating end of the female terminal shown in FIG. 1 further illustrating the angled contact areas in the passageway of the electrical terminal in an unbiased condition.

In accordance with a still further aspect of the present invention and as best seen in FIG. 5, the enlarged contact areas 57–58 are formed in the sidewalls 53–54 of the channels 45–46 at an angle 60 to the sidewalls 53–54, respectively. FIG. 5 represents the terminal mating end 22 of the female terminal when the male pin 50 is not inserted therein. In this condition, the slit 48 may provide generally uniform separation between the channels 45–46. A related cross sectional view can also be seen in FIG. 7. In the unbiased condition of the mating end 22 illustrated in 5, the angle 60 that the enlarged contacting surfaces 57–58 are disposed at with respect to the sidewalls 53–54 will depend upon a number of factors including the longitudinal length of the mating end 22, the resiliency of the channels 45–46, the location of the enlarged contact areas along the sidewalls of the mating end 22, the location of any notches 60, and the like. However, in the embodiment illustrated in FIGS. 1–8, angle 60 may typically be in a range of about 2 to 15 degrees and preferably approximately 3 to 5 degrees.

Figure 6:
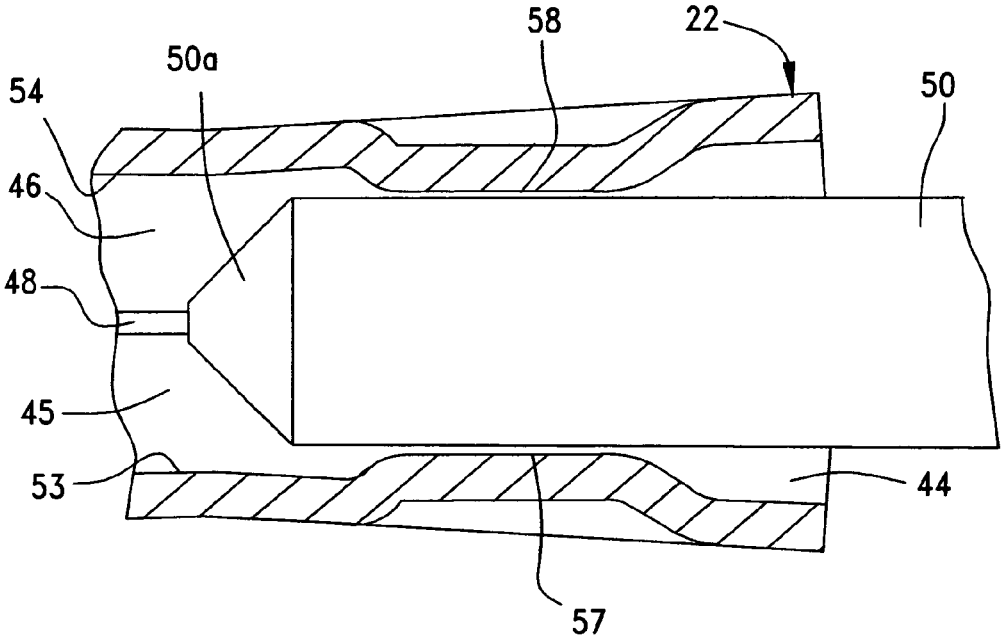
FIG. 6 is an enlarged longitudinal sectional view of the mating end of the female terminal similar to FIG. 5, but illustrating a male pin inserted into the passageway of the terminal with sidewalls biased outwardly such that the angled contact areas become coplanar with the sides of the male pin to substantially engage the pin.
Figure 7:
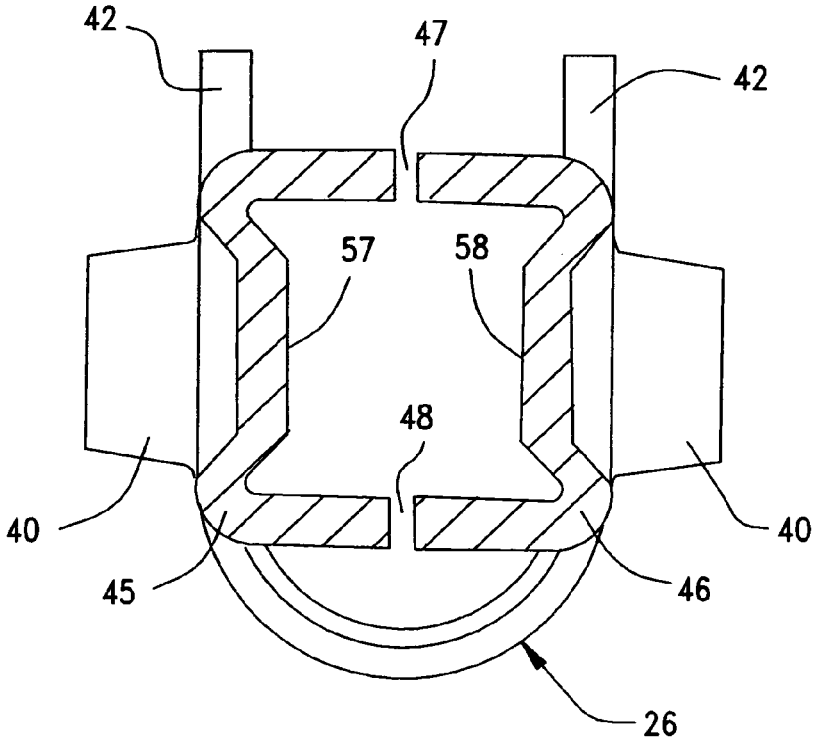
FIG. 7 is a cross sectional view of the mating end of the female terminal in the unbiased condition of FIG. 5 at the enlarged and angled electrical contact areas, and further illustrating the mating end of the terminal subdivided into opposing halves with slits therebetween to enable the end of the female terminal to expand in the horizontal direction when a male pin is inserted into the passageway of the female terminal.
Figure 8:
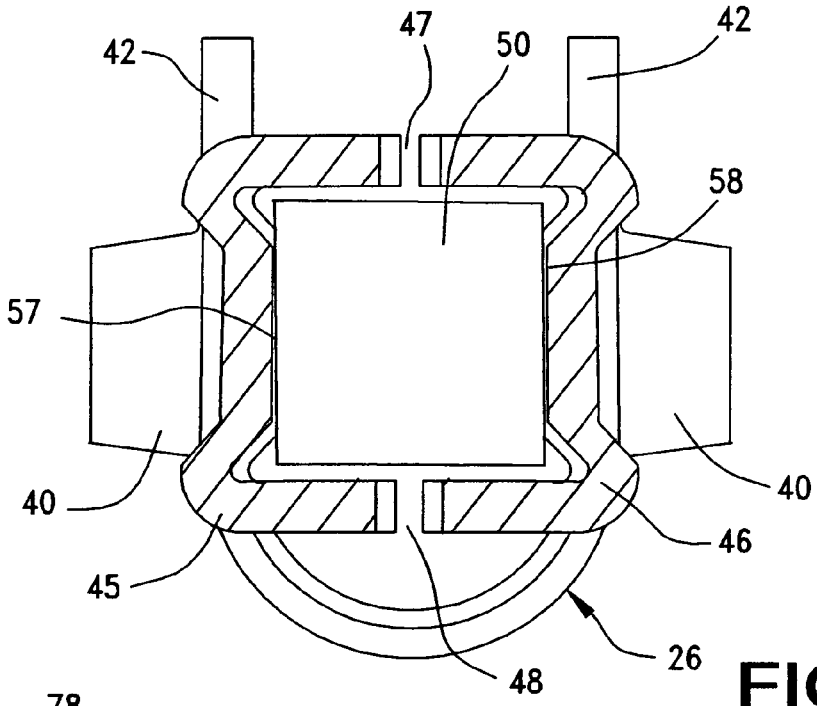
FIG. 8 is a cross-sectional view similar to FIG. 7 but with a male pin inserted into the passageway of the female terminal, and further illustrating the expansion of the mating end in the horizontal direction to accommodate the male pin between the enlarged and angled contact areas.

FIGS. 6 and 8 illustrate the mating end 22 of the female terminal with the male pin 50 inserted therein. In this condition, the channels 45–46 are biased apart along the slits 47–48 as the channels 45–46 flex or rotate apart to accommodate male pin 50. Since the enlarged contact areas 57–58 are disposed near the front or entrance to the passageway 44, maximum separation between the channels 45–46 occurs at the front of the mating end 22 near the contact areas 57–58, with less separation towards the intermediate portion 26 of the female terminal. Thus, as the channels 45 and 46 rotate away from each other, as the male pin 50 is inserted in the passageway 44, the previously angled and enlarged contact areas 57–58 now become substantially coplanar with the flat sides of the male pin 50 to substantially contact the male pin along the contact areas 57–58.

Figure 9:
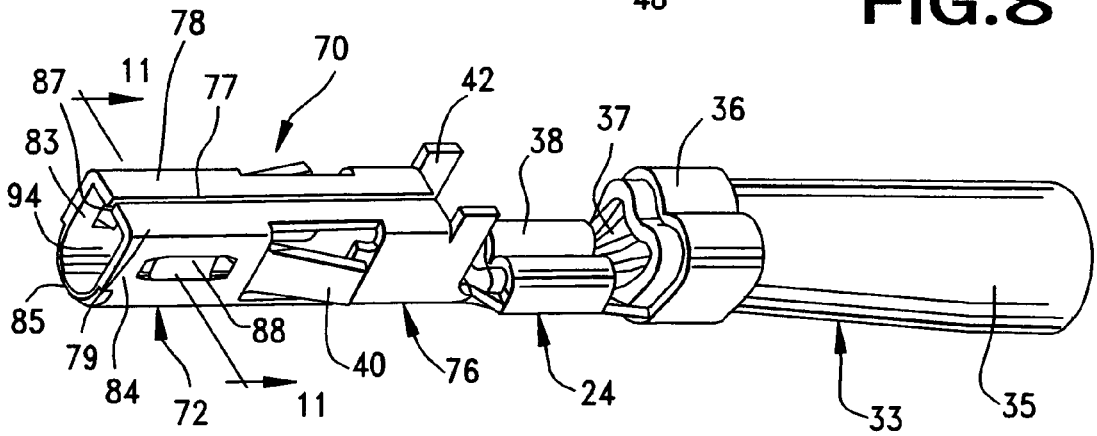
FIG. 9 is a perspective view of another embodiment of the present invention in which one of the sides of the female electrical terminal is curved and without a longitudinal separation, as in the electrical connectors illustrated in FIGS. 1–8.
Figure 10:
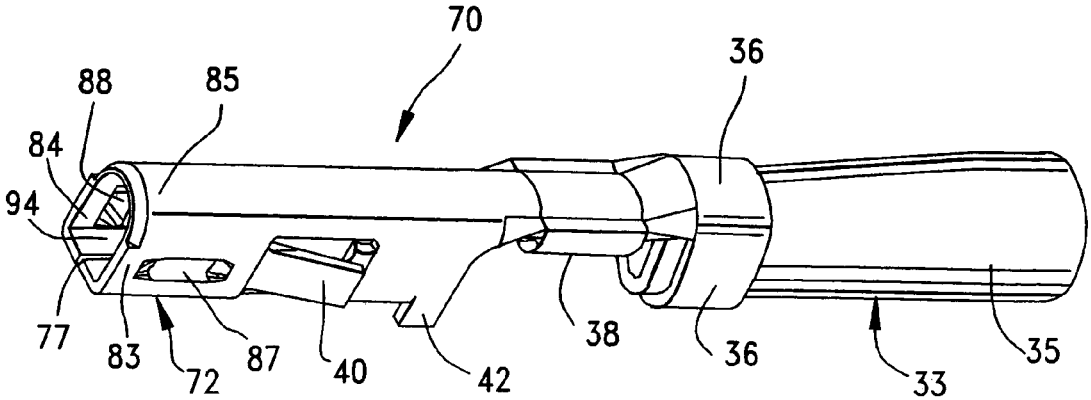
FIG. 10 is another perspective view of the electrical terminal shown in FIG. 9, but taken from the opposite side thereof.
Figure 11:
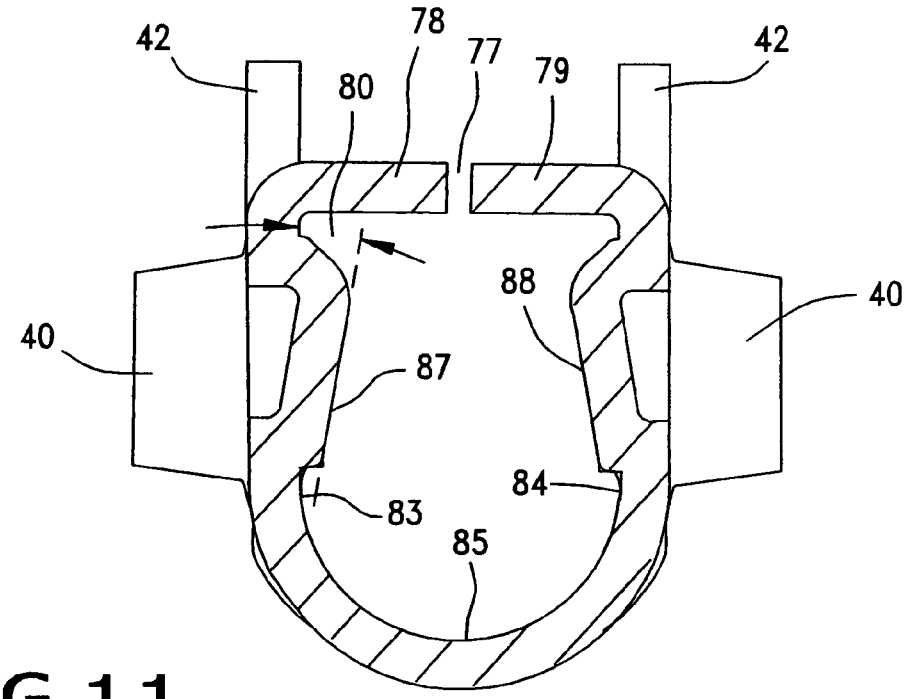
FIG. 11 is a cross sectional view of the electrical terminal of FIG. 9 taken at sectional line 11—11, further illustrating the enlarged and angled contact areas and the rounded side.

FIGS. 9–12 illustrate an alternative embodiment of the present invention in which the mating end of the terminal is configured in a manner somewhat similar to the intermediate portion 26 of the female terminal 20 in FIGS. 1–8. In FIGS. 9–11, a female terminal, generally designated 70, includes a mating portion or end, generally designated 72, a terminating portion, generally designated 24 and an intermediate portion, generally designated 76. The mating end 72 of female terminal 70 has a pair of generally parallel and spaced apart sidewalls 83 and 84 that are integrally connected by a curved bight 85. The other edges of sidewalls 83–84 are bent at an approximate right angle to form legs 78–79. Legs 78–79 terminate short of each other to define a slit 77, which extends longitudinally along the body of the terminal from the front edge of the mating end 72 to the rear of the intermediate portion 76.

At least one enlarged contact area 87 or 88, and preferably two enlarged contact areas 87–88 are formed in the sidewalls 83–84 of the terminal, such as in the mating end 72. These contact areas 87–88 are preferably disposed at an angle 80 to the sidewalls 83–84, as best illustrated in FIG. 11. In this embodiment, angle 80 depends upon various factors, but will generally be in the approximate range of 1 to 10 degrees.

However, unlike the angled contact areas 57–58 of female terminal 20 in FIG. 5, which are angled to the sidewalls in the longitudinal direction, angled contact areas 87–88 of female terminal 70 in FIG. 11 are angled with respect to the sidewalls in the transverse direction. This is because female terminal 70 expands in the transverse direction to accommodate insertion of male pin 50 into the passageway 94 of terminal 70. The flexing in terminal 70 occurs mostly in the area of the bight 85 such that sidewalls 83–84 rotate apart from each other, about a respective line parallel to the insertion direction of the male pin, as the male pin is inserted in passageway 94.

Figure 12:
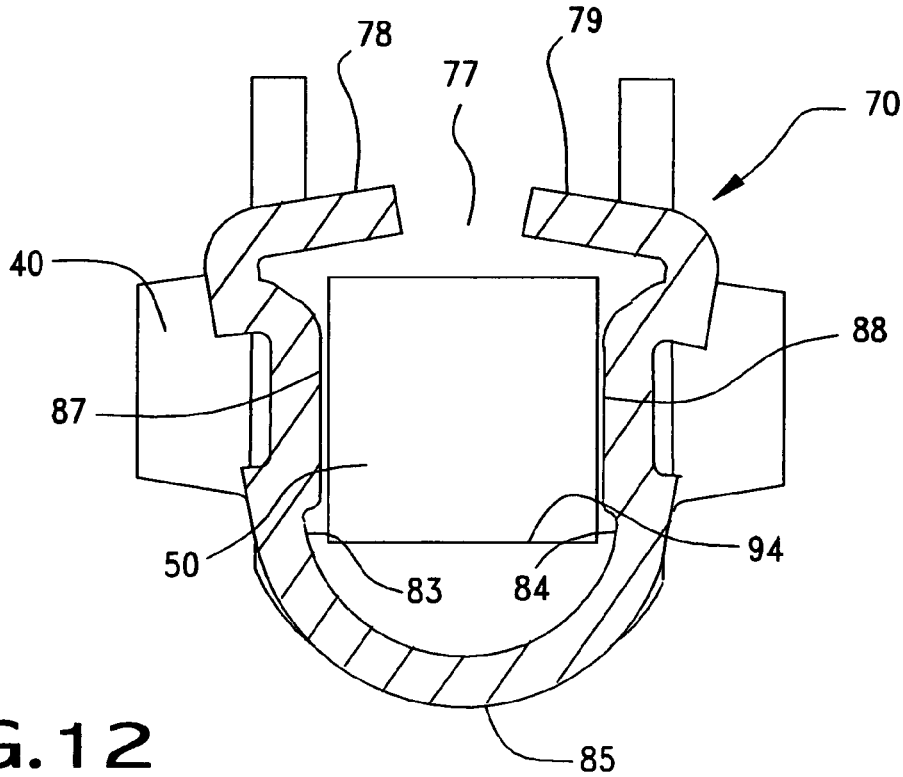
FIG. 12 is a cross sectional view similar to FIG. 11 with a male pin inserted into the female terminal showing how the female terminal flexes in its cross section such that the flat angled contact surfaces become parallel and spaced apart to electrically engage the sides of the male pin.

FIG. 12 illustrates a cross sectional view of female connector 70 when the male pin is inserted into the passageway 94. In this condition, sidewalls 83 and 84 have rotated apart, which has increased the separation of the legs 78–79 and which has also increased the width of slit 77 between legs 78–79. As a result, the previously angled contact areas 87 and 88 have now become substantially coplanar with the flat sides of the male pin for improved electrical contact therewith.

Figure 13:
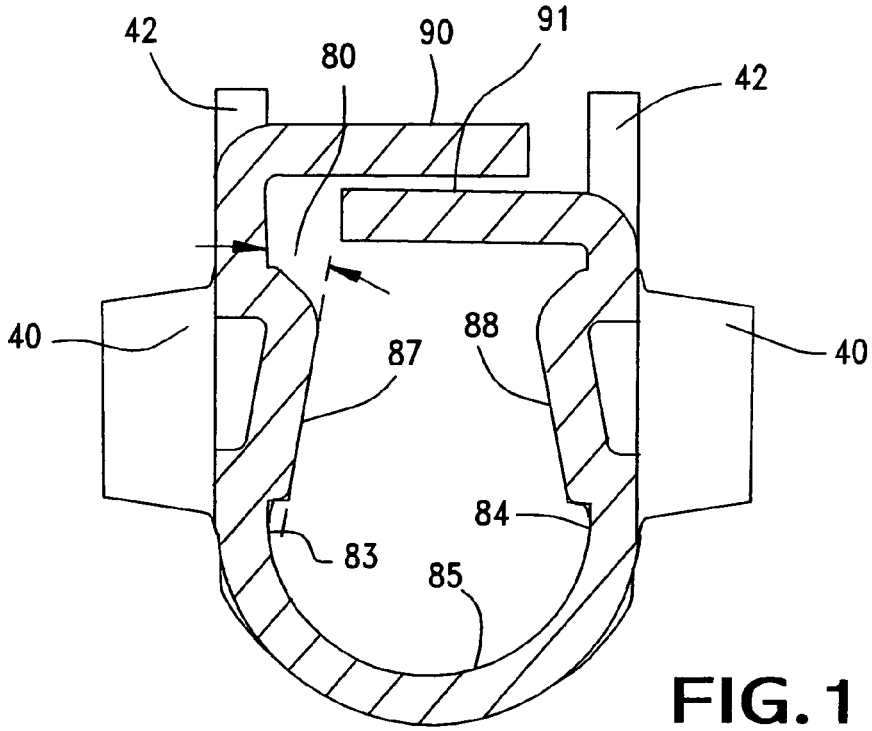
FIG. 13 is a cross sectional view of the electrical terminal similar to FIG. 11, with overlapped rather than abutting legs.
Figure 14:
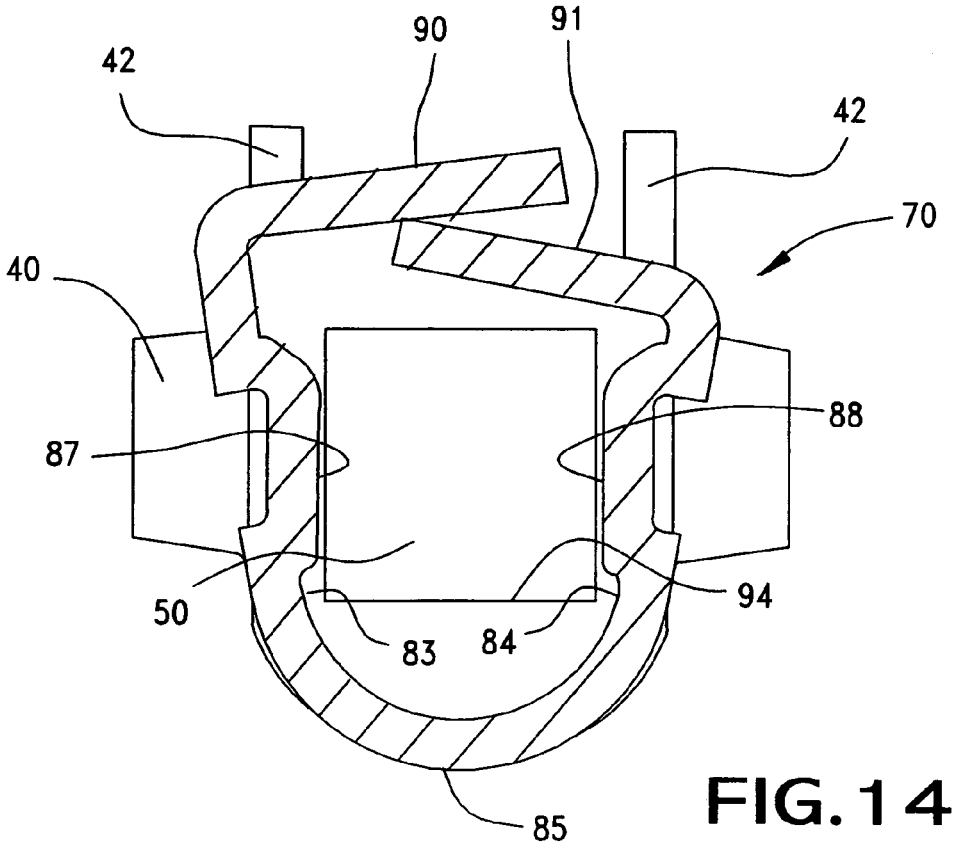
FIG. 14 is a cross sectional view similar to FIG. 13 with a male pin inserted into the female terminal showing how the female terminal flexes in its cross section such that the flat angled contact surfaces become parallel and spaced apart to electrically engage the sides of the male pin.

FIGS. 13 and 14 represent a modification of the alternative embodiment illustrated in FIGS. 9–12. FIGS. 13 and 14 are the same as FIGS. 11 and 12 with the exception of legs 90–91. In the modification the legs 90–91 form overlapped sections as compared with the shorter legs 78–79 defining a slit between them. Providing overlapped sections is easier to manufacture due to stamping and bending tolerances.

The female terminal 70 has similar advantages over the prior art terminals, such as those mentioned above, including reduced force per unit area exerted on the male pin to reduce plating loss associated with repeated insertions, increased contact area to reduce heating problems at the contact interface, less critical centering of the male pin within the passageway of the female terminal, and the like.

It is to be understood that terms, such as "top", "bottom" or the like, as used herein and in the claims hereof, are used as relative terms only in order to provide a more clear and concise understanding of the invention. Such terms are not to be construed as limiting, because the terminals of the present invention may be oriented in many different directions in actual use, as is well known to persons skilled in the art.

It will be understood that the invention may be embodied in other specific forms without departing from the spirit or central characteristics thereof. The present examples and embodiments are, therefore, to be considered in all respects as illustrative and not restrictive, and the invention is not to be limited to the details given herein.

What is claimed is:

1. A female terminal for receiving and mating with a male terminal of the type having at least one flat surface extending longitudinally along the male terminal, said female terminal comprising:

a terminal body with a mating end and a circuit connecting end;

a terminal receiving passageway defined in the mating end including two opposed spaced apart sidewalls extending lengthwise along the passageway and moveable between an unmated position, where no male terminal is inserted into said passageway, to a mated position, where the male terminal is inserted into said passageway; and at least one inwardly projecting contact area disposed along one of said sidewalls, said at least one inwardly projecting contact area having a flat contacting surface disposed at an angle to said at least one of said sidewalls for engaging, in said mated position, said at least one flat surface of the male terminal when the male terminal is inserted into the terminal receiving passageway said flat contacting surface further disposed at an angle to a plane of a sidewall opposed to said one of said sidewalls in the unmated position;

said sidewalls resiliently flexing, from said unmated position, away from each other into said mated position so that the flat contacting surface of the at least one inwardly projecting contact area is in generally coplanar contacting relationship with said at least one flat surface of the male terminal when the male terminal is inserted into said passageway.

2. The female terminal as claimed in accordance with claim 1 wherein an inwardly projecting contact area with a flat contacting surface is disposed on each of said two spaced apart sidewalls, each of said inwardly projecting contact areas are disposed at an angle to their respective sidewall for engaging opposite flat surfaces of said male terminal when the male terminal is inserted into said passageway, and said flat contacting surfaces of the inwardly projecting contact areas are in coplanar contacting relationship with the opposing flat surfaces of the male terminal when the male terminal is inserted in the passageway.

3. The female terminal as claimed in accordance with claim 1 wherein each of said sidewalls is of generally U-shaped cross section wherein the legs of the U-shaped cross sections are spaced apart from each other.

4. The female terminal as claimed in accordance with claim 3 wherein said U-shaped cross sections of the sidewalls of the female terminal flex upon insertion of the male terminal into the passageway and upon engagement between the male terminal and the flat contacting surfaces of the inwardly projecting contacts, said sidewalls providing normal forces at the flat contacting surfaces against the flat surfaces of the male terminal to provide electrical contact between the male and female terminals.

5. The female terminal as claimed in accordance with claim 1 wherein said sidewalls are separated by opposed lingitudinally extending slits so that they flex about an axis generally parallel to a respective sidewall and in a direction perpendicular to the terminal receiving passageway when said male terminal is inserted into said passageway.

6. The female terminal as claimed in accordance with claim 1 wherein the sidewalls are separated by one logitudinally extending slit so that they along flex about an axis parallel to the direction of insertion of the male terminal in the passageway.

7. The female terminal as claimed in accordance with claim 1 wherein the flat contacting surfaces of the inwardly projecting contacts are elongated in the direction of insertion of the male terminal in the passageway.

8. The female terminal as claimed in accordance with claim 1 wherein a cut is made partially into at least one of the sidewalls of the female terminal to control the flexing of the sidewall when the male terminal is inserted into the passageway.

* * * * *